US011058144B2

(12) United States Patent
Mullen

(10) Patent No.: US 11,058,144 B2
(45) Date of Patent: Jul. 13, 2021

(54) CIGARETTE PAPER TWISTING APPARATUS

(71) Applicant: Patrick Michael Mullen, San Jose, CA (US)

(72) Inventor: Patrick Michael Mullen, San Jose, CA (US)

( * ) Notice: Subject to any disclaimer, the term of this patent is extended or adjusted under 35 U.S.C. 154(b) by 0 days.

(21) Appl. No.: 16/869,104

(22) Filed: May 7, 2020

(65) Prior Publication Data

US 2021/0177045 A1 Jun. 17, 2021

Related U.S. Application Data

(60) Provisional application No. 62/948,449, filed on Dec. 16, 2019.

(51) Int. Cl.
*A24C 5/54* (2006.01)

(52) U.S. Cl.
CPC ..... *A24C 5/54* (2013.01)

(58) Field of Classification Search
CPC ..... A24C 5/12; A24C 5/54
See application file for complete search history.

(56) References Cited

U.S. PATENT DOCUMENTS

2019/0297936 A1* 10/2019 Kang ..... A24C 5/54
2019/0320710 A1* 10/2019 Sirois ..... A24C 5/12
2021/0022388 A1* 1/2021 Sullivan ..... A24C 5/54

* cited by examiner

*Primary Examiner* — Eric Yaary
(74) *Attorney, Agent, or Firm* — Donald R. Boys; Central Coast Patent Agency LLC

(57) ABSTRACT

A twisting apparatus has a rotor driven around an axis by an electric motor, a microcontroller; three elastomeric balls at ends of pivot arms mounted to a lower surface of the rotor such that arms may pivot to move the elastomeric balls toward or away from the central axis, a clutch mechanism having a clutch plate with pins interacting with the pivot arms such that rotation of the rotor from a stopped position in one direction closes the elastomeric balls toward the central axis, and rotation of the rotor from a stopped position in the opposite direction retracts the elastomeric balls; and a detection device sending a trigger event to the micro-controller. The trigger event closes the elastomeric balls on the cigarette end, then reverses to release.

6 Claims, 7 Drawing Sheets

CIGARETTE PAPER TWISTING APPARATUS

CROSS-REFERENCE TO RELATED DOCUMENTS

The present application claims priority to a Provisional Patent Application (PPA) 62/948,449, filed on Dec. 16, 2019. All disclosure of the parent application is incorporated herein at least by reference.

BACKGROUND OF THE INVENTION

1. Field of the Invention

The present invention is in the field of automated machines and pertains particularly to methods and apparatus for twisting to close a paper cigarette end

2. Discussion of the State of the Art

Automated machines for many purposes are well known in the art. In the particular technical field tobacco products, special papers, cigarette rolling belt machines, and single cigarette dispensers are known, among other apparatus.

Cigarette is a general term that may include many forms of tobacco and other materials rolled into typically a paper enclosure to be lit on one end to produce smoke inhaled from an opposite end. A user that rolls or packs a previously prepared paper cylinder to make a cigarette must manually close open ends to secure the tobacco or other material in the paper roll.

What is clearly needed is an automated machine and associated method for closing the end of a paper cigarette that may be more efficient and require less physical contact than finishing by hand.

BRIEF SUMMARY OF THE INVENTION

In one embodiment a twisting apparatus for twisting a paper end of a filled cigarette paper is provided, having a twister head with a cylindrical housing having a central axis, a rotor mounted by a bearing in the cylindrical housing, the rotor driven around the axis by a drive wheel at an upper end of the twisting apparatus, an electric motor driving the rotor, a microcontroller executing coded instructions controlling and driving the electric motor, three elastomeric balls at ends of three pivot arms mounted to a lower surface of the rotor at equal arcuate intervals, such that arms may pivot to move the elastomeric balls synchronously toward or away from the central axis, a clutch mechanism at a lower end of the twisting apparatus having a clutch plate with pins interacting with the pivot arms such that rotation of the rotor from a stopped position in one direction closes the elastomeric balls toward the central axis, and rotation of the rotor from a stopped position in the opposite direction retracts the elastomeric balls away from the central axis, and an electronic detection device positioned for detection of a cigarette end inserted along the central axis with the balls retracted and the rotor stopped, detection sending a trigger event to the micro-controller. A trigger firstly initiates rotation of the rotor for a specific number of rotations in the direction to close the elastomeric balls on the cigarette end, and the elastomeric balls closing on the cigarette end induce the clutch plate to rotate the balls to twist the cigarette end, and wherein, after the specific number of rotations twisting the cigarette end, the motor stops, then reverses, retracting the elastomeric balls, and stops with the elastomeric balls retracted, allowing the twisted cigarette end to be withdrawn.

In one embodiment the apparatus further comprises a support base housing the microcontroller, a data repository storing coded instructions for operation, and a power supply, an upwardly extending stem supporting the electric motor with an upwardly-extending drive shaft, and an arm extending laterally from an upward extremity of the stem. The twister head mounts to an end of the arm away from the stem, with the axis facing downward, such that a cigarette to be twisted may be inserted upward into the twister head to trigger the electronic detection device, and wherein the rotor of the twister head is driven through a first drive wheel turned by a belt from a second drive wheel mounted to the upwardly-extending drive shaft in the stem.

In one embodiment the base includes a power switch and the power supply is a rechargeable battery. Also in one embodiment the motor is one of a stepper motor, a servo motor, or a linear actuator. In one embodiment the clutch mechanism includes a user-adjustable lever for varying a threshold pressure in closing the elastomeric balls, at which the balls assembly is induced to begin to rotate. And in one embodiment the pins in the clutch plate engage slots in each of the pivot arms carrying elastomeric balls.

DETAILED DESCRIPTION OF THE INVENTION

In various embodiments described in enabling detail, the inventor provides a unique twisting machine that uses an object detection mechanism to trigger a clutch assembly to close a gripping mechanism to grip a paper end of a cigarette and then twist that cigarette end. The present invention is described in enabling detail using the following examples, which may describe more than one relevant embodiment falling within the scope of the present invention.

Figure 1:
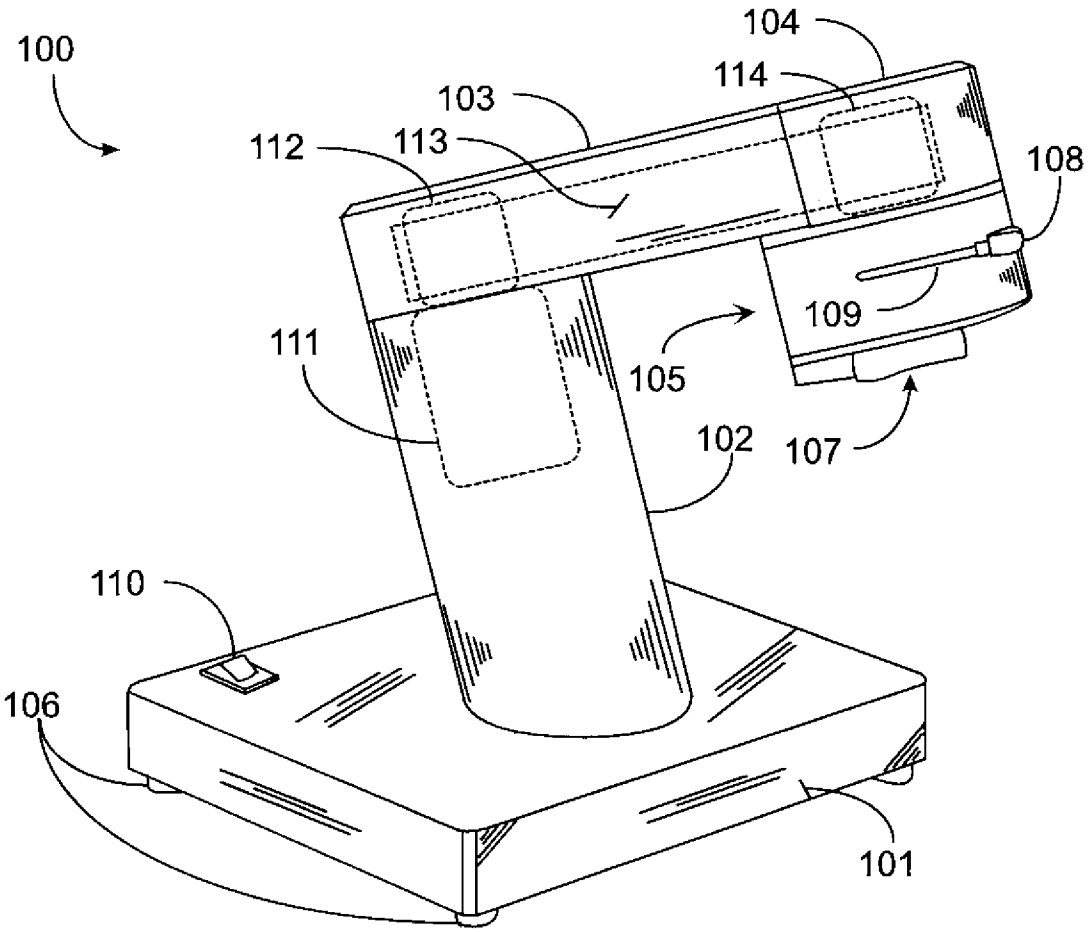
FIG. 1 is a perspective view of a cigarette twisting machine according to an embodiment of the present invention.

FIG. 1 is a perspective view of a cigarette twisting machine 100 according to an embodiment of the present invention. Cigarette twisting machine 100 is adapted in this embodiment, as a desktop machine a user may operate to mechanically twist the ends of a rolled or packed cigarette. The term cigarette is intended as a generic term for any materials that might be rolled with paper or packed into a previously prepared paper form.

Twisting machine 100 has a base housing 101 with corner feet 106 providing stability of the machine on a counter top. Base housing 101 may be a stainless steel base that may house electronics and a power source such as, for example, a micro controller, memory for a software or firmware routine, and a rechargeable battery. Although not illustrated, it may be assumed that electronics and a battery housed within base housing 101 of cigarette twisting machine 100 may be accessed through the bottom of base housing 101 by opening a compartment panel, unscrewing a cover plate, or the like. Base housing 101 includes a power switch 110 for switching power on and off to electrical elements of the machine. In one embodiment, machine 100 may draw power from an electrical outlet.

Twisting machine 100 includes a center stem housing 102 in the form, in one embodiment, of an annular cylinder fixed at one end to base housing 101. Center stem housing 102 may be somewhat adjustable relative to the angle of inclination from vertical above the top surface of base housing 101. Center stem housing 102 may be fabricated of stainless steel or other durable materials.

An electric motor 111 may be provided to drive a rotor and clutch-plate assembly housed within a twister head 105. Electric motor 111 may be one of several types of motors including a servo motor or a stepper motor. In one embodiment the motor provided may be a linear actuator. Electric motor 111 may be mounted within center stem housing 102 and may include a motor shaft fitted with a power transfer wheel 112 over which a drive belt 113 may be fitted, the drive belt extending to a drive wheel 114 provided to rotate the rotor and clutch assembly within twister head 105.

Power and communication bus structures (not illustrated) may be routed within center stem housing 102 to support motor 111. The upper end of center stem housing 102 is fixed to a lateral extension arm 103. Extension arm 103 may be fabricated from stainless steel or other durable materials. Lateral extension arm 103 may house drive belt 113 connected to transfer wheel 112 and to drive wheel 114 fixed at an end of a rotor, clutch assembly, and gripping mechanism housed within twister head 105.

Lateral extension arm 103 of cigarette twisting machine 100 has connection to a drive wheel housing 104. Drive belt 113 extends into drive wheel housing 104 and is fitted over drive wheel 114. The drive belt may include a toothed inner belt surface to mate with the grooves on drive wheel 114.

Cigarette twisting machine 100 includes a twister head 105 mounted in alignment with and connected to drive wheel 114. Twister head 105 in one embodiment comprises a clutch assembly, a central rotor and a lever/cam operated gripping mechanism that can be rotated to open and to close, and may close to grip the paper end of a cigarette for twisting, and may be opened again to release the cigarette. Twist head 105 may be configured to rotate the gripping mechanism to a closed state based on the detection of a trigger event.

A trigger event to activate the twister head may be a packed or rolled cigarette with an open end breaking an object detection circuit. To twist a cigarette end completely, the gripper mechanism must be rotated a number of times while closed upon the end of an inserted cigarette. Twist head 105 has mounted thereon an object detection mechanism 107, which in this example may be a photo emitter and detector pair positioned over a center opening aligning with a cigarette inserted for twisting.

A user may present an untwisted cigarette body in longitudinal alignment with twist head 105 so that the open end of the cigarette faces the gripper mechanism inside twist head 105. Inserting the cigarette breaks a beam maintained by object detection mechanism 107. The beam is generally aimed orthogonally to the longitudinal direction of the cigarette end. The detection of the break in the detection circuit causes a micro-controller to output to the motor to begin rotation.

The process includes a reverse rotation operation to open the gripping mechanism to release the twisted cigarette, once the end of the cigarette paper is twisted sufficiently.

In one embodiment, a clutch assembly is provided and integrated with the rotor and the griping mechanism, the clutch assembly including a clutch pressure plate assembly having a ramp adjustment lever 108 protruding through a housing slot 109 for setting desired frictional drag between a rotor and clutch plate.

A user operating twisting machine 100 may quickly finish previously rolled cigarettes one at a time. In this embodiment, the cigarette twisting machine head 105 is facing angularly downward so that a user presenting an open cigarette end will not spill contents. Stem 102 may be angularly and perhaps length adjusted to present twist head 105 at a desired height and angle for comfortable work. It might also be noted that a cigarette requiring a twisted end may be one having a mouthpiece previously attached to the paper and only one twist operation is required to close the open end. In this case the contents are previously packed into a paper cone, which may aflare out slightly towards the open end.

Figure 2A:
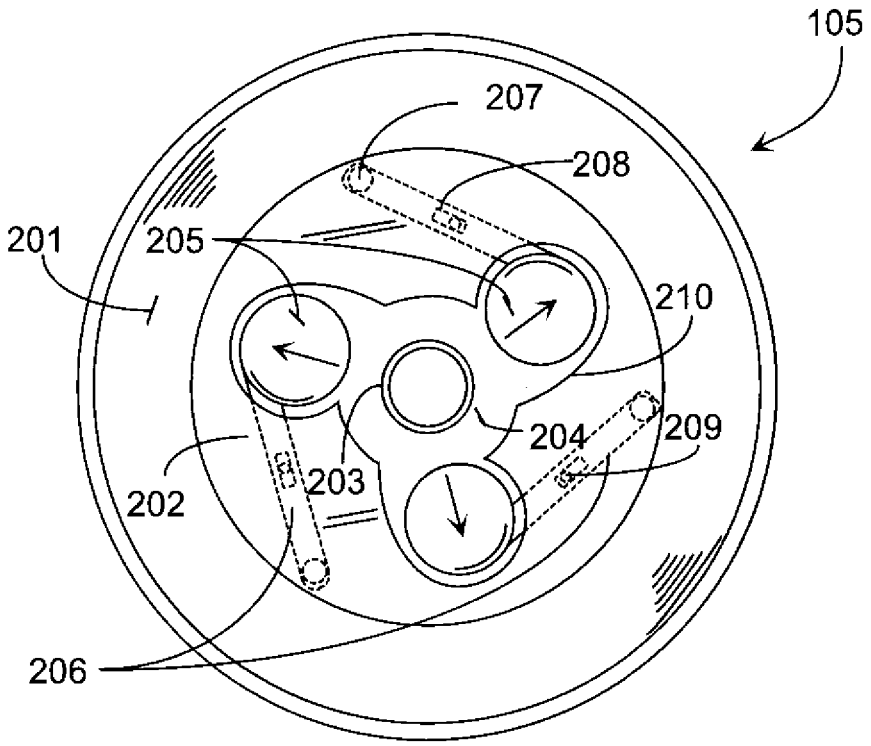
FIG. 2A is an overhead view of the twister head of the cigarette twisting machine of FIG. 1 in an open state.

FIG. 2A is an overhead view of twister head 105 of twisting machine 100 of FIG. 1 in an open state. Twister head 105 is circular in form and houses a clutch assembly and gripping mechanism for gripping and twisting cigarette ends. In this implementation, a clutch assembly having a clutch plate 201 is mounted over a rotor 202. A central cavity 203 is provided in a rotor 202 having a rotor face. Central cavity 203 has an inside diameter larger than the diameter of a rolled cigarette for twisting.

Clutch plate 201 in his example is installed over rotor 202 and is concentric with and rotatable relative to rotor 202. Rotor 202 may freely rotate independently of clutch plate 201. Rotor 202 has a pattern relief cut 210 provided on the rotor face. Pattern relief cut 210 provides material relief for position of and for movement of three elastomeric spheres 205. Elastomeric spheres 205 are the gripping elements of a clutch-operated gripping mechanism. Elastomeric spheres 205 are shown in an open position in this view. Elastomeric spheres 205 may be plastic balls coated with an elastic material, or they may be molded from an elastic material such as rubber propylene, silicone, or the like.

Each elastomeric sphere 205 is mounted to one end of a pivot arm 206, of which there are three in this example. There is one pivot arm 206 per elastomeric sphere 205. The opposite ends of pivot arms 206 are mounted on rotor face 202 via pivot bolts 207. Pivot arms 206 may pivot freely about pivot bolts 207. Pivot bolts 207 are spaced apart one hundred and twenty degrees on a bolt circle just inside the outer diameter of rotor 202. Pivot arms 206 each include an elongated pin slot 208 in the direction of the pivot arm and central to the pivot arm.

In this example, three interlocking drive pins 209 are provided on clutch plate 201 beneath the rotor face, each pin engaged with a slot 208 on a pivot arm 206, the pins interlocking with the slots for the purpose of opening and closing the gripping mechanism. These elements provide the gripping mechanism for gripping the paper end of a rolled or content-packed cigarette. In this implementation, elastomeric spheres 205 are presented at an open state at the ends of each pivot arm 206, each sphere nested in a cavity provided by material relief pattern 210 in the rotor face. The open position is the result of respective rotational positions between rotor 202 and clutch plate 201.

Figure 2B:
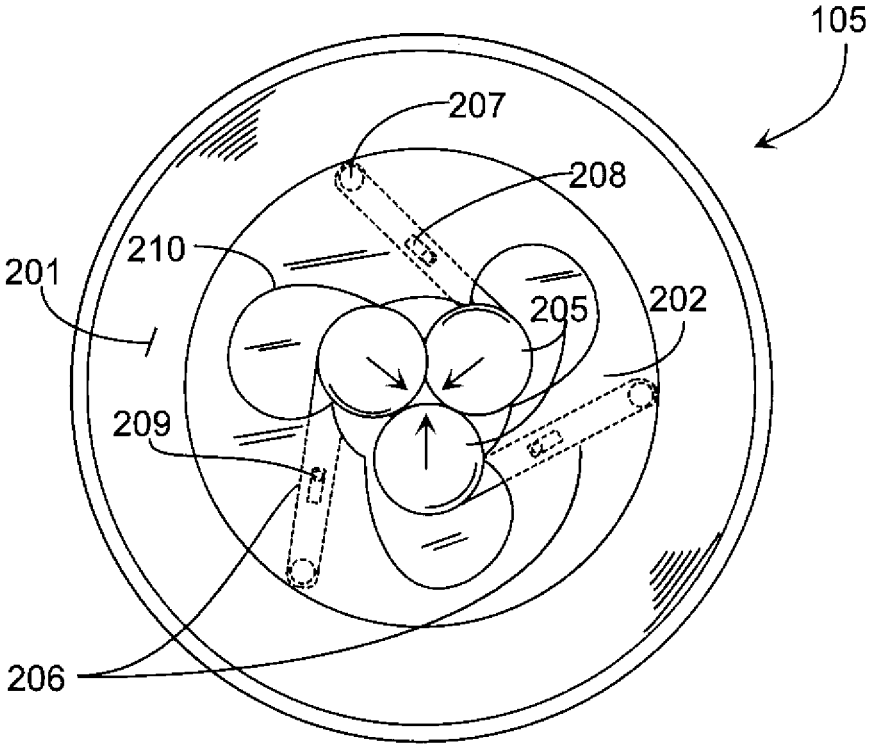
FIG. 2B is an overhead view of the twister head of the cigarette twisting machine of FIG. 1 rotated to a closed state.

FIG. 2B is an overhead view of twister head 105 of the twisting machine rotated to a closed state. Twister head 105 is closed in this view to a gripping position of elastomeric spheres 205 toward the center of twister head 105 in the direction of the arrows. The closed position reflects a rotational difference between rotor 202 and clutch plate 201. Rotating rotor 202 clockwise relative to clutch plate 201 brings the elastomeric spheres 205 closer in unison to the axis of rotation of the rotor. This function works to close the gripping mechanism over the paper end of a presented cigarette. Interlocking pins 209 move pivot arms 206 into the desired closed position. Reversing rotor direction relative to the clutch plate brings elastomeric spheres 205 of the gripping mechanism back to the open state.

Twisting the paper end of a cigarette may be performed by the motor spinning rotor 202 several times (approximately four revolutions) while the elastomeric spheres 205 are gripping the paper end of the cigarette. Reversing rotor direction and rotating rotor 202 counter-clockwise will pull the gripping mechanism back to the open state within one revolution, releasing the cigarette with the twisted end as in view 2A above. Elastomeric spheres 205 travel in unison toward the axle of rotation and away from the axle of rotation. In one embodiment, a user may manually start the twisting head process when the user has a cigarette in position for twisting by flipping a toggle switch. In another embodiment, an object detection mechanism analogous to detection mechanism 107 of FIG. 1 may be provided and armed (electric circuit) to automatically trigger the twisting motion of twister head 105 to grip and twist a paper cigarette end upon positive object detection.

Figure 3A:
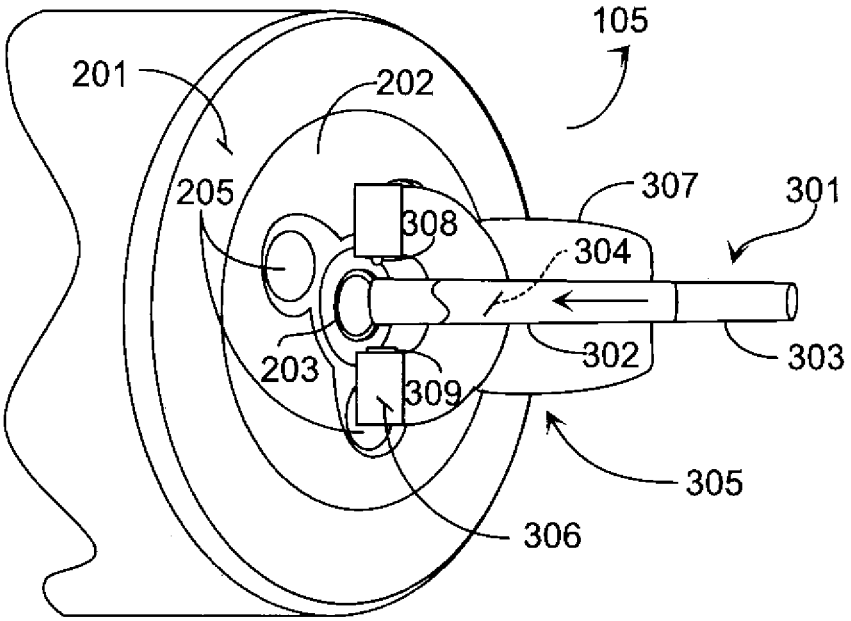
FIG. 3A is a partial perspective view of the twister head of the cigarette twisting machine of FIG. 1 with an optical trigger mechanism and in an open state.

FIG. 3A is a perspective view of twister head 105 of twisting machine 100 of FIG. 1 in an open state with an optical trigger mechanism. Twister head 105 includes an object detection mechanism 305. Object detection mechanism 305 is in this example an electronic device adapted to detect objects by photo emission and detection. Object detection mechanism 305 includes a plug 307 for receiving power from an electric power source, and a dipole beam emission and detection structure 306 adapted with a photo emitter 308 at one pole and a photo detector 309 on the opposite pole.

Object detection mechanism 305 may generate a beam of visible or infrared light which may be directed through photo emitter 308 to be received by detector 309. Any interruption of the beam, for example by an object placed in the beam's path, is registered by detector 309 as a trigger state. Object detection mechanism 305 is positioned over and mounted to twister head 105 so that the emitted beam runs orthogonally to the direction of the longitudinal rotation axis of twister head 105.

In order to trigger a twisting event, a user may bring a previously rolled cigarette such as cigarette 301 into a position to be twisted. In this view, the gripping mechanism is open with elastomeric spheres 205 expanded out in position relative to the axis of rotation and at idle. Cigarette 301 in this example includes a mouthpiece 303 attached to a paper cone 302. Paper cone 302 is packed with tobacco or other material 304 up to a distance from the free paper end of cone 302. A user may align cigarette 301 to central cavity 203 and may move the cigarette in alignment closer to the cavity to break the beam and trigger the grip and twist sequence.

Detector 309 may be calibrated, in one embodiment, to ignore beam interruption if an object interrupting the beam is translucent to mildly opaque. If the object is dense or more than mildly opaque, the detector may be calibrated to register detection of the interrupting object such as the dense portion of the cigarette body or the content pack line. In this implementation, the photo beam is not considered interrupted by the paper of cone 302 of cigarette 301 since light may pass through it. The pack line of cigarette contents in cigarette 301 may be what causes a beam interruption as being substantial enough to order a trigger event. It is important for the paper end of cone 302 to be within physical reach of the elastomeric gripping spheres when a twist event is initiated. Likewise, adjustment may be made to a clutch pressure plate assembly to set desired frictional drag between the clutch plate and rotor.

Figure 3B:
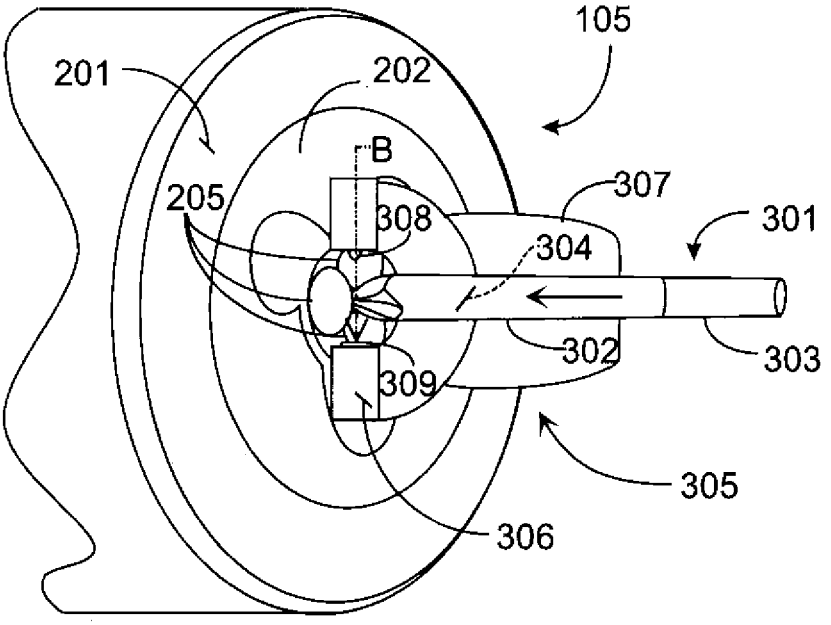
FIG. 3B is a partial perspective view of the twister head of the cigarette twisting machine of FIG. 1, with the optical trigger mechanism of FIG. 3A and in an open state.

FIG. 3B is a perspective view of twister head 105 of twisting machine 100 of FIG. 1, with the optical trigger mechanism of FIG. 3A, and in a closed state. A beam B is shown emitted from emitter 301 and received by detector 309 of object detection mechanism 305. Beam B is broken when a user brings cigarette 301 within reach of elastomeric spheres 205. Detector 309 reports a break of a detection circuit back to a micro-controller. The micro-controller may generate instruction to the electric motor to rotate rotor 202 clockwise to close the gripping mechanism around cigarette 301. A next default action of twisting the cigarette end occurs after a successful grip of the paper end. Rotor 202 may rotate up to four times, each time resulting on one full twist of the paper cigarette end.

In one embodiment, one revolution may close the gripping mechanism onto the cigarette paper end and four additional revolutions create the twisted end. In another case one-half revolution may close the gripping mechanism and two full revolutions may create the twisted end. The force that elastomeric spheres have in gripping the paper may be calibrated as part of a clutch friction adjustment. The exact number of revolutions of the rotor for twisting a cigarette end may also be calibrated.

Figure 4:
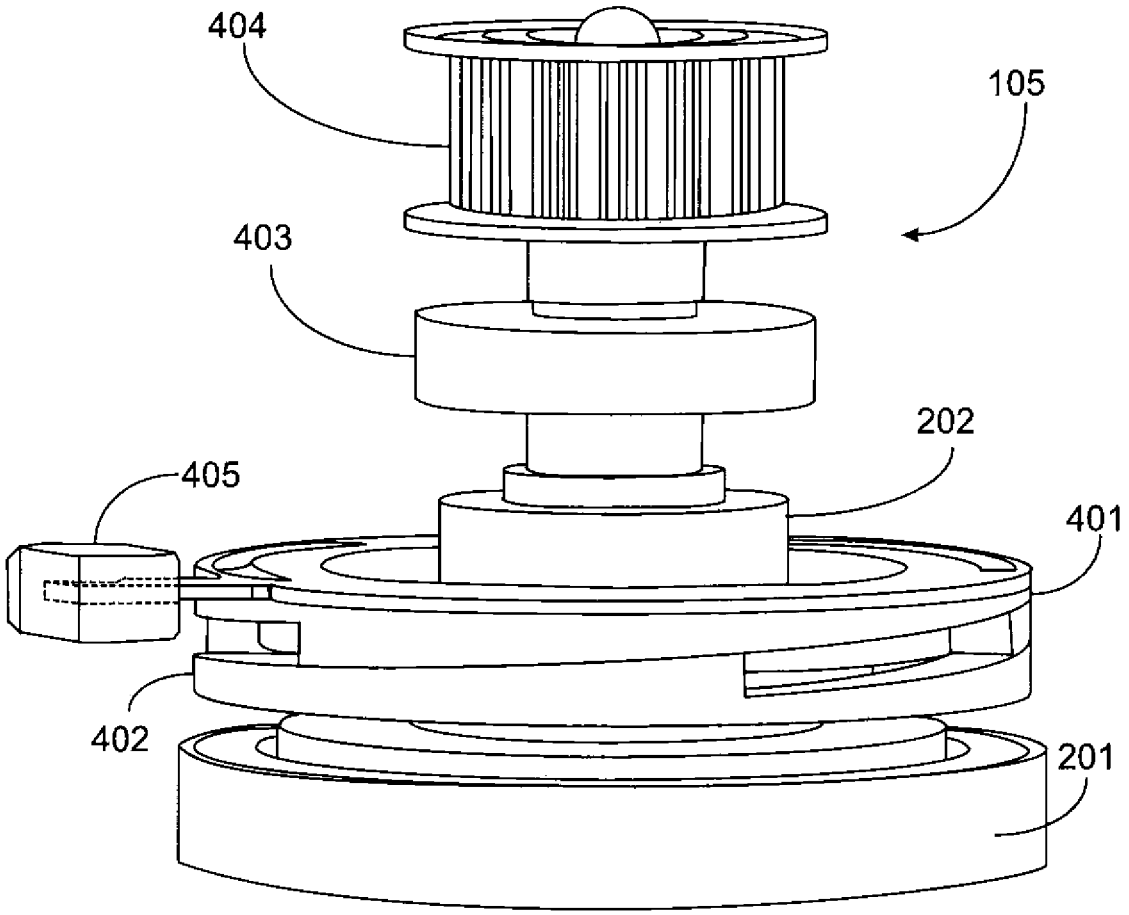
FIG. 4 is an elevation view of a clutch assembly of the twister head of the cigarette twisting machine of FIG. 1.

FIG. 4 is an elevation view of a clutch assembly of the twister head 105 of the twisting machine of FIG. 1. In this example, a rotor 202 is driven by a drive wheel 404, which is analogous in design and function to drive wheel 114 of FIG. 1. A bearing collar 403 is provided in between the clutch assembly of twister head 105 and drive wheel 404. A clutch pressure-plate assembly is provided to create drag between a clutch plate and rotor. The clutch pressure plate assembly includes opposing circular ramp parts 401 (top ramp) and 402 (bottom ramp). Clutch plate 201 in elevation view covers the gripping mechanism and the face of the rotor where the elastomeric spheres (205 and pivot arms (206) are installed.

The pressure plate assembly includes at least three compression springs (not illustrated) that are mounted on the bottom face of ramp part 402 and adapted to exert spring force between the clutch pressure plate 402 and the clutch plate 201. An operator may use a lever 405 analogous to lever 108 depicted in FIG. 1 to change the gap between the clutch pressure plate assemblies circular ramp components 401 and 402, which in turn calibrates the grip force of the gripping mechanism on the paper cigarette end.

The rotor may freely rotate a certain degree before the clutch plate also rotates in the same direction. In a preferred implementation, the rotor spins according to instruction provided by a firmware (FW) or software (SW) instruction stored in memory and executed upon a trigger event caused by a cigarette breaking the beam as described above.

Figure 5:
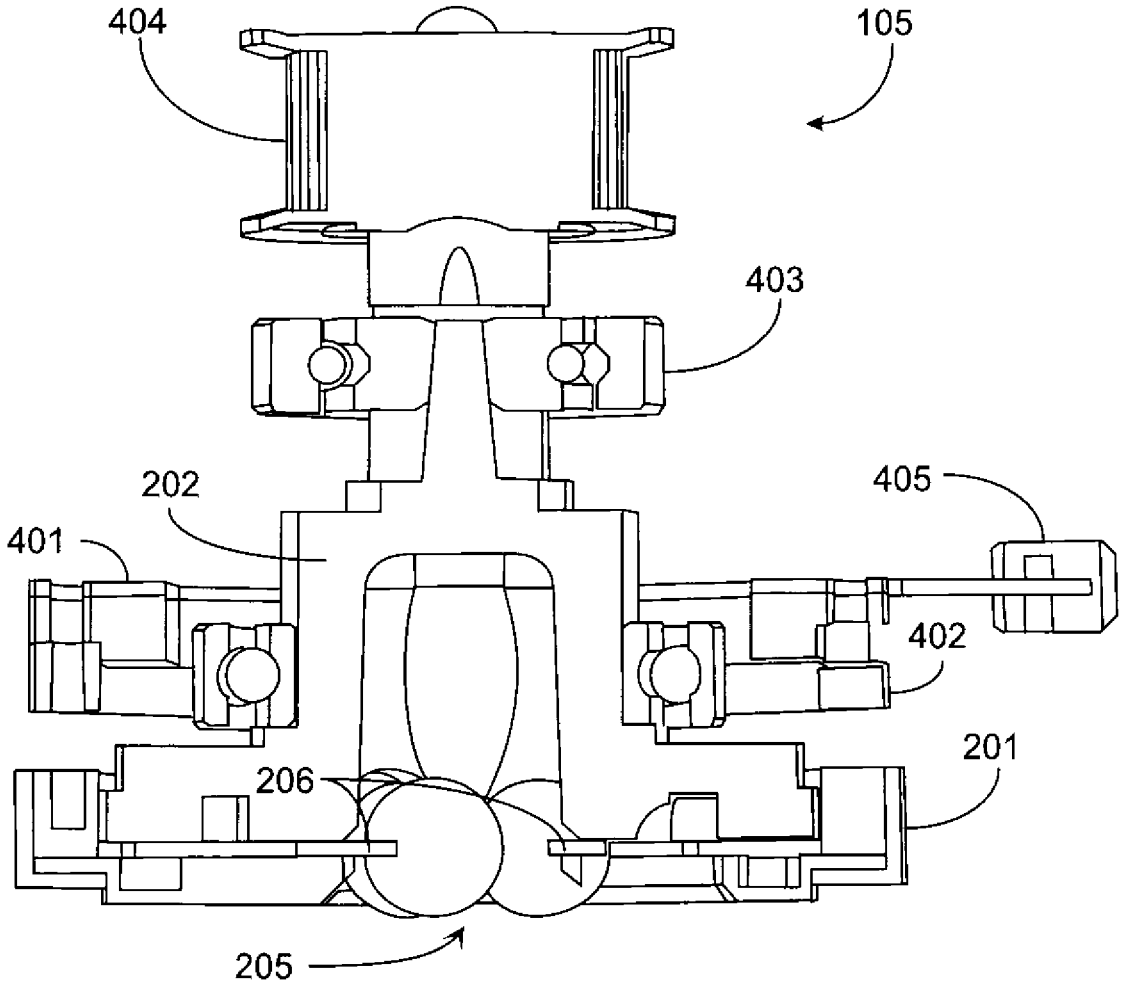
FIG. 5 is a sectioned view of the clutch assembly of FIG. 4.

FIG. 5 is a cutaway view of the clutch assembly of FIG. 4. Drive wheel 404 directly drives rotor 202 in this embodiment. Clutch plate 201 includes the interlocking pins 209 described in FIG. 2A and FIG. 2B that are required to enable opening and closing of the gripping mechanism featuring elastomeric spheres 205 connected to pivot arms 206. Spin revolutions by the rotor 202 may be ordered by an instruction sequence that is provided by a micro-controller executing a FW instruction or a SW instruction per trigger event.

A gear ratio may be applied in one embodiment between the clutch plate 201 and the rotor 202 to enable more or fewer rotor revolutions before the clutch plate spins in the same direction as the rotor. There may be a maximum clutch plate friction adjustment position effected by lever 405 providing the most gripping force from the converged elastomeric spheres onto the paper end of a cigarette. There may also be a minimum clutch plate friction adjustment position effected by moving lever 405 providing the least gripping force. There may be additional clutch plate adjustment positions between the maximum and minimum positions. A user may, for example, move lever 405 to marked positions to provide more clutch plate drag or less clutch plate drag to work with cigarettes having specific paper stiffness ratings or grades.

Figure 6:
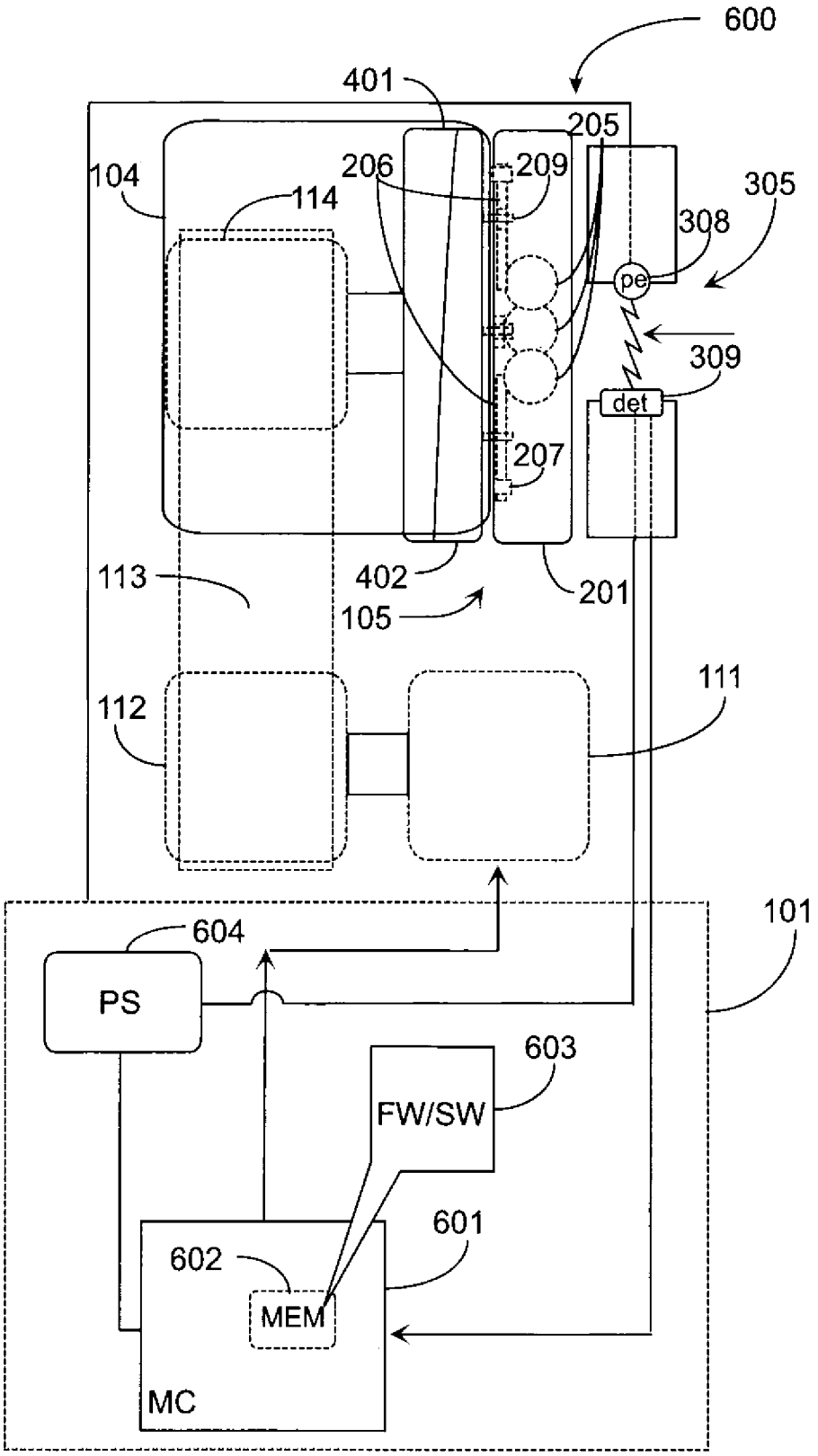
FIG. 6 is a block diagram depicting basic electric components of the cigarette twisting machine of FIG. 1.

FIG. 6 is a block diagram 600 depicting basic electronic and mechanical components of the twisting machine of FIG. 1. Broken boundary 101 represents the base portion of the twisting machine as depicted in FIG. 1 and having the same element number. A micro-controller 601 is provided within base 101, and may include a connected memory (MEM) 602 supporting an executable software program 603. Software 603 may comprise the coded instructions for conducting a single twist sequence for the paper end of a cigarette.

Micro-controller 601 may be powered by a power source (PS) 604. Power source 604 may comprise a rechargeable battery. PS 604 has power bus connection to MC 601. PS 604 may also provide power to object detection mechanism 305 enabling an armed circuit that may be breached at a beam emitted by photo emitter (pe) 308 and received at detector (det) 309. In this example, both photo emitter 308 and photo detector 309 have power bus connection to PS 604. This view is logical only, as unit 305 may also receive power through a single connection to PS 604 and may distribute that power within the unit to the appropriate components photo emitter 308 and photo detector 309.

Photo detector 309 has a communications bus connection to micro-controller 601 for reporting a trigger event to the micro-controller. A paper end of a cigarette may be presented to the object detection mechanism from the right in this view according to the directional arrow. Twister head 105 generally includes drive wheel housing 104 as depicted in FIG. 1, a drive wheel 605 for rotating the rotor 202, the clutch assembly comprising clutch plate 201 and the clutch pressure plate assembly comprising upper and lower circular ramps 401 and 402, and the gripping assembly comprising elastomeric spheres 205 mounted on pivot arms 206, which are interlocked with clutch plate pins 209 to drive the spheres toward the axle of rotation or back away from the axle of rotation of rotor 202 (rotor not illustrated).

In use, an operator may bring a cigarette in alignment with the rotational axis toward the twister head 105 in the direction of the arrow. When the pack line of the cigarette interrupts the beam emitted from photo emitter 308, detector 309 registers with micro-controller 601. Micro-controller 601 aided by FW/SW 603 outputs an instruction sequence or a series of single instructions to motor 111. Power transfer elements including transfer wheel 112, drive belt 113 and drive wheel 114 are depicted in broken boundaries for reference. The instruction sequence may instruct motor 605 to rotate the rotor clockwise to [grip], and then to rotate clockwise several times [twist], and then to rotate counter-clockwise to [release] a twisted cigarette.

In an alternative embodiment, the paper gripping mechanism comprises three blades without elastomeric spheres. The blades function as a shutter mechanism that open and close over the rotational axis of the twister head. In this embodiment, a single elastomeric sphere positioned at center deeper in the cavity may be used as a backstop against the blades to grip the paper while the mechanism spins to twist the paper. In this alternative embodiment, the same twist instructional sequence may be used. The only difference between the two methods are the form of the elements to grip and twist the paper end of the cigarette.

Figure 7:
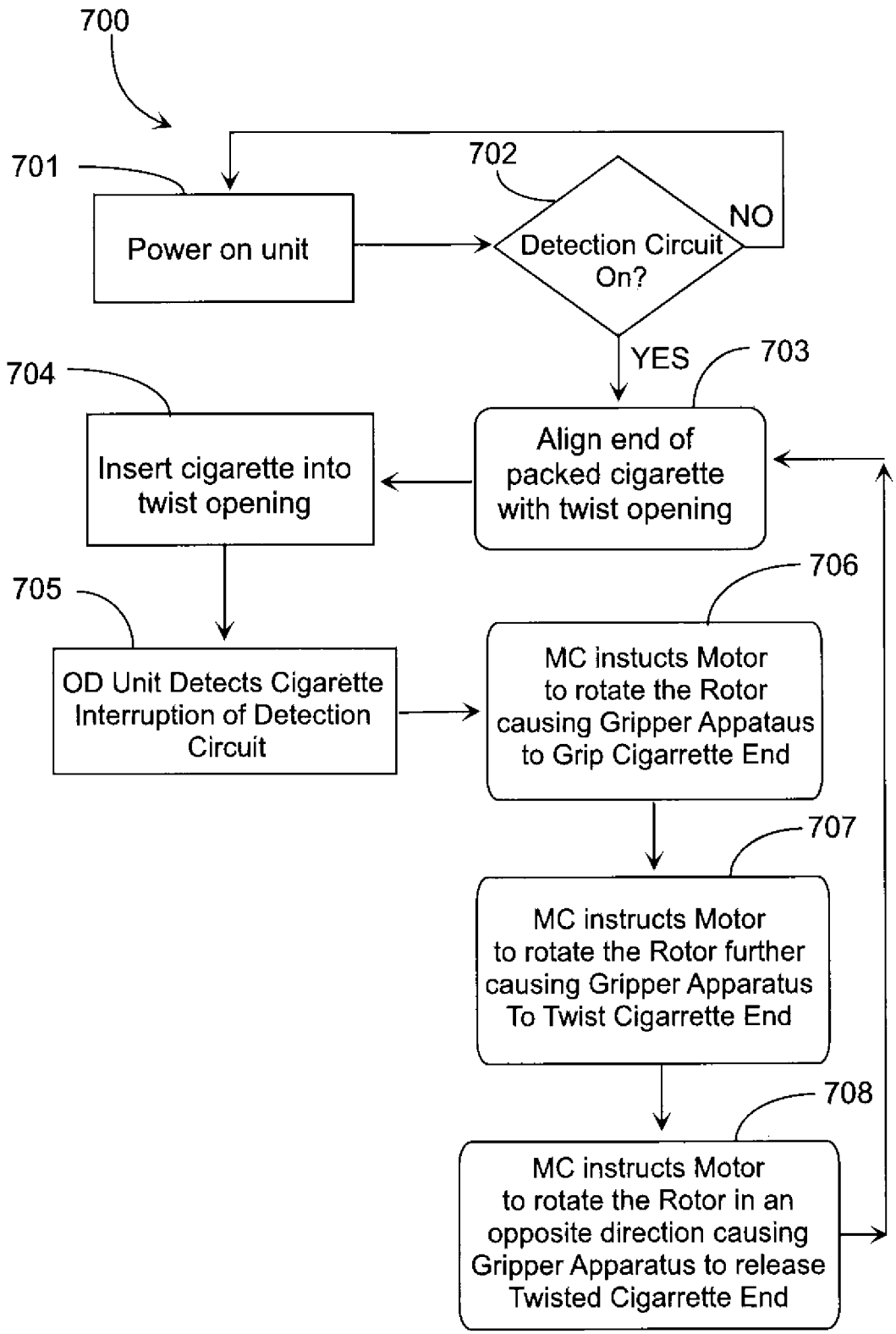
FIG. 7 is a process flow chart depicting steps for twisting the end of a cigarette using the cigarette twisting machine of FIG. 1.

FIG. 7 is a process flow chart 700 depicting steps for twisting the end of a cigarette using the twisting machine of FIG. 1. At step 701, a user may power on the desktop twisting machine analogous to cigarette twisting machine of FIG. 1. A power switch may be provided analogous to switch 110 of FIG. 1. At step 702, the user may determine if the object detection circuit is armed or on. If at step 702, the detection circuit is not on, the process may loop back. The unit may illuminate when powered on providing visual confirmation. If the object detection mechanism is illuminated, it is on and the twister head is now ready to accept a cigarette for twisting.

At step 703, the user may align the paper end of a previously rolled or previously packed cigarette with the twist opening of the twister head. At step 704, the user may insert the paper end of the cigarette closer and into the twist opening. At step 705, the object detection unit detects the cigarette interruption of the detection circuit. The interruption may be the cigarette pack or fill line breaking the emitted photo beam. The detector may be calibrated in one embodiment to allow the paper end pass through the beam until the dense body of the cigarette is detected before registering a trigger event. The trigger is registered at step 705 and passed to the micro-controller through a push or pull scheme.

At step 706, the micro-controller aided by the FW or SW instruction instructs the drive motor to rotate the rotor against the clutch plate causing the gripper apparatus to grip the paper end of the cigarette. The actual amount of rotational movement may be calibrated as an amount of rotation to achieve grip. At step 707, the motor is instructed to rotate the rotor further a number of revolutions required to effect a twist that will hold. This number may be about four revolutions. The clutch plate rotates with the rotor on this part of the sequence. At step 708, the motor is instructed to rotate in the opposite direction an amount required to release the grip and carry the elastomeric spheres back to the resting open position. Steps 706, 707, and 708 may be carried out in one instruction to the motor to perform the sequence.

In one embodiment, the motor sends three instructions to the motor with a short pause between each action. In one embodiment, two modes may be operated. A first mode may be three separate instructions with a pause between instructions. This may allow a user who may still be calibrating for grip to make sure the grip is correct before twisting. A second mode may be all three instructions in one communicated action with no pause between actions providing the fastest batch production. After the cigarette twister head releases a cigarette, the process loops back to step 703 for the next cigarette.

It will be apparent to one with skill in the art that the desktop twisting machine of the invention may be provided using some or all of the described features and components without departing from the spirit and scope of the invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will be apparent to the skilled person that the arrangement of elements and functionality for the invention is described in different embodiments in which each is exemplary of an implementation of the invention. These exemplary descriptions do not preclude other implementations and use cases not described in detail. For example, alterations could be made in the design of the apparatus and the arrangement of the components without departing from the spirit and scope of this invention. The invention is limited only by the breadth of the claims below.

I claim:

1. A twisting apparatus for twisting a paper end of a filled cigarette paper, comprising:

a twister head comprising:

a cylindrical housing having a central axis;

a rotor mounted by a bearing in the cylindrical housing, the rotor driven around the axis by a drive wheel at an upper end of the twisting apparatus;

an electric motor driving the rotor;

a microcontroller executing coded instructions controlling and driving the electric motor;

three elastomeric balls at ends of three pivot arms mounted to a lower surface of the rotor at equal arcuate intervals, such that arms may pivot to move the elastomeric balls synchronously toward or away from the central axis;

a clutch mechanism at a lower end of the twisting apparatus having a clutch plate with pins interacting with the pivot arms such that rotation of the rotor from a stopped position in one direction closes the elastomeric balls toward the central axis, and rotation of the rotor from a stopped position in the opposite direction retracts the elastomeric balls away from the central axis; and an electronic detection device positioned for detection of a cigarette end inserted along the central axis with the balls retracted and the rotor stopped, detection sending a trigger event to the micro-controller;

wherein the trigger event firstly initiates rotation of the rotor for a specific number of rotations in the direction to close the elastomeric balls on the cigarette end, and the elastomeric balls closing on the cigarette end induce the clutch plate to rotate the balls to twist the cigarette end, and wherein, after the specific number of rotations twisting the cigarette end, the motor stops, then reverses, retracting the elastomeric balls, and stops with the elastomeric balls retracted, allowing the twisted cigarette end to be withdrawn.

2. The twisting apparatus of claim 1 further comprising:

a support base, housing the microcontroller, a data repository storing coded instructions for operation, and a power supply;

an upwardly extending stem supporting the electric motor with an upwardly-extending drive shaft; and an arm extending laterally from an upward extremity of the stem;

wherein the twister head mounts to an end of the arm away from the stem, with the axis facing downward, such that a cigarette to be twisted may be inserted upward into the twister head to trigger the electronic detection device, and wherein the rotor of the twister head is driven through a first drive wheel turned by a belt from a second drive wheel mounted to the upwardly-extending drive shaft in the stem.

3. The twisting apparatus of claim 2, wherein the base includes a power switch and the power supply is a rechargeable battery.

4. The twisting apparatus of claim 1, wherein the motor is one of a stepper motor, a servo motor, or a linear actuator.

5. The twisting apparatus of claim 1 wherein the clutch mechanism includes a user-adjustable lever for varying a threshold pressure in closing the elastomeric balls, at which the balls assembly is induced to begin to rotate.

6. The twisting apparatus of claim 1, wherein the pins in the clutch plate engage slots in each of the pivot arms carrying elastomeric balls.

* * * * *